US005474480A

United States Patent [19]

Schwarz et al.

[11] Patent Number: 5,474,480

[45] Date of Patent: Dec. 12, 1995

[54] CONTROL SYSTEM FOR OPERATING THE DRIVE ASSEMBLY OF A SHIP

[75] Inventors: Josef Schwarz, Friedrichshafen; Christoph Göbel, Immenstaad; Thomas Voss, Tettnang; Gerhard Maurer; Manfred Braig, both of Friedrichshafen; Raimund Auer, Eriskirch; Peter Brinck, Uhldingen-Mühlhofen; Günter Roth, Markdorf, all of Germany

[73] Assignee: ZF Friedrichshafen AG, Germany

[21] Appl. No.: 182,141

[22] PCT Filed: Jul. 28, 1992

[86] PCT No.: PCT/EP92/01709

§ 371 Date: Jan. 14, 1994

§ 102(e) Date: Jan. 14, 1994

[87] PCT Pub. No.: WO93/02914

PCT Pub. Date: Feb. 18, 1993

[30] Foreign Application Priority Data

Aug. 1, 1991 [DE] Germany ..... 41 25 432.5

[51] Int. Cl.[6] ..... B60K 41/00

[52] U.S. Cl. ..... 440/86; 440/87

[58] Field of Search ..... 114/144 R; 440/1, 440/6, 75, 84, 86, 87; 60/567; 74/480 B, 484 R; 192/3.51, 3.54, 3.63, 4 R, 4 C

[56] References Cited

U.S. PATENT DOCUMENTS

| | | | |
|---|---|---|---|
| 2,925,156 | 2/1960 | Grant et al. . | |
| 4,099,476 | 7/1978 | Inoue et al. . | |
| 5,031,561 | 7/1991 | Nilsson | 114/144 R |

FOREIGN PATENT DOCUMENTS

| | | |
|---|---|---|
| 2558577 | 9/1977 | Germany . |
| 3907841 | 9/1989 | Germany . |

*Primary Examiner*—Stephen Avila
*Attorney, Agent, or Firm*—Davis, Bujold & Streck

[57] ABSTRACT

The invention concerns a control system for operating a drive assembly of a ship. The system consists of an engine (1), a transmission (3) and an adjustable clutch (4) for forward and reverse motions. A control station (15), a control lever (27) and a control electronics (15) are provided for adjusting the direction of motion and the speed of the ship. In order to influence the reaction of the ship when changing direction, several reversing aids are provided according to the invention. The pilot can use the reversing aids by actuating a selection key (24) located on the control station.

14 Claims, 2 Drawing Sheets

CONTROL SYSTEM FOR OPERATING THE DRIVE ASSEMBLY OF A SHIP

The invention in general concerns a control system for operating a drive assembly of a ship. The drive assembly has at least an engine which drives a propeller shaft via a transmission having at least one adjustable clutch for forward and reverse motion. Control and sensor means are provided to make changing the engine speed or the degree of slip of the clutch possible. A control station with control means through which the pilot can influence the direction of motion and the speed of the ship, by actuating at least one control lever, are also provided. The control system further has control electronics for processing input and output signals in order to maintain the desired operating conditions of the drive assembly.

In a control system known already for operating a drive assembly, a mode selector device is provided in which a specific mode of operation can be preselected. Depending on the preselected mode of operation, a specific function is assigned to the control lever of the control station. If a travel (cruise) mode is selected, the clutch for forward motion is engaged. The engine speed is changed with the control lever in order to adjust a specific travel speed. If a slow (trolling) mode is preselected with the mode selector device, the function assigned to the control lever changes, As long as said mode is selected, the engine is operated at a specific, uniform speed. The speed of motion is changed with the control lever so as to select a higher or lower degree of slip of the clutch of the transmission.

The speed of the propeller shaft is thus changed by the degree of slip of the clutch. The known control system has control electronics to which an input and output unit, an indicator unit and control and sensor means are attached. In the control system already known, it is possible to effect changes of direction in the trolling or cruise mode by a corresponding movement of the direction/speed lever. The changes of direction are carried out in an automatically timed sequence by the control unit. When changing from a cruise to a trolling mode, the engine reduces the speed to a speed preselected by a torsion adjuster. When changing from the trolling to the cruise mode, the engine speed changes in direction toward an idling speed, fully engages the clutch and then the engine speed increases to the control lever position (DE-A 39 07 841, column 12, lines 16–33).

In the control system explained above, although the pilot is relieved of manual operation by an automatically timed sequence, the proposed procedure has practically no effect on the time characteristics of the ship both when changing from the trolling to the cruise mode and vice versa.

This invention is, therefore, based on the problem of influencing the reaction of the ship, when changing direction, by enabling the pilot to use at least one reversing aid which can change the time characteristics of the ship in a specific manner. Here the reaction periods, above all during starting or turning manoeuvres, should be improved specially with low propeller shaft speeds.

The problem on which the invention is based is solved by the fact that during an operation (trolling) mode of the drive assembly, the clutch is fully engaged after engaging a direction of motion and the acceleration phase is terminated by transmitting a control signal to the control electronics which, upon receipt of the signal, converts the clutch to the adjusted slip operation. This solution is a manual reversing aid which the pilot selects by actuating a selector key on the control station. When attempting starting or turning manoeuvres during the trolling mode, the clutch is fully engaged in the acceleration phase immediately after engaging the direction of motion. The ship is thereby accelerated with a thrust corresponding to the prevailing speed. The pilot can terminate the acceleration phase when there is sufficient reaction of the ship. In a preferred embodiment, termination of the acceleration phase is tied to an adjustment movement of the selector switch (control lever). When "end of acceleration" appears, the pilot normally reacts with an adjustment of the control lever directed to a "reduction of the drive speed". Use of this reaction is made by terminating the acceleration phase by a slight decrease in the trolling speed. With the production of a negative adjustment gradient of the control lever of a nominal value for the trolling speed, a control signal is transmitted to the control electronics. The control electronics then converts the clutch to the adjusted slipping operation so that a trolling speed automatically occurs. The ship reaction during the trolling operation is considerably improved during starting and turning manoeuvres. The control electronics can interact with the slipping clutch in such a manner that the clutch is protected against thermal overload.

According to the invention another solution of the stated problem is that during an operating (trolling) mode of the drive assembly, the clutch is completely engaged after engaging the direction of motion and the acceleration phase is terminated by transmitting a control signal to the control electronics, while the clutch is engaged, by adjusting the speed of the propeller shaft to a trolling speed. It is advantageous here to deduce the control signal for the control electronics from the speed of the ship. Upon reaching a desired speed of the ship, the control signal is produced or delivered to the control electronics. In a preferred solution, the nominal speed of the ship is preselected, for instance, with the selector switch. With the aid of an adequate error detector, the speed of the ship is determined and the control signal is deduced from a comparison of the nominal/actual values. Here either the relative speed of the ship, with regard to the water, or the absolute speed of the ship above ground can be used. The first mentioned possibility is advantageous, for instance, when salvaging a damaged ship while the other possibility is used in the area of the stationary assembly. A possible reversing aid can be automated with this suggestion.

Finally, another solution of the stated problem is that during one mode (trolling) of operation of the drive assembly, the clutch is engaged to the extent that the preselected trolling speed and direction of rotation are adjusted on the propeller shaft and in a changeover range where the propeller is also driven as turbine, the control electronics can keep the propeller shaft speed constant. In this solution, the preselected trolling speed and direction of rotation automatically occur on the propeller. The control electronics then, with the aid of the control and sensor means, keep the propeller speed constant specially taking into consideration the fact that during the reversing operation the propeller can be driven as turbine in a changeover range. Said reversing aid is—as has been said—automatable and is specially adequate particularly for manoeuvres in which the ship's speed must be slowly increased.

In a preferred embodiment of a control system, the control station has means for preselecting a desired reversing sequence. Said means can consist, for instance, of a selector switch preferably designed as luminous key. By actuating the key, it is possible to preselect a specific reversing sequence which starts semi-automatically or fully automatically when starting or reversing the ship. In the above mentioned reversing aid to be manually started, the control lever is momentarily actuated for adjusting the trolling speed. A negative adjustment gradient is produced during said adjustment operation.

An advantageous interpretation of the control for selection of the travel speed, via a control lever with which the engine speed is set in the cruise mode, consists in making, for the slow travel mode, a superposition of the nominal speed adjustment in one range of the path of the control lever where admissible speeds for slow travel can be adjusted. The superposition means that in said range instead of, or in addition to, a change of the engine speeds, a change of the speed of the propeller shaft, that is of the trolling speed, takes place with priority. Said superposition can advantageously be undone with electric means known per se.

For an economical and also low-pollution drive, it is advantageous to assign automatically a specific engine speed to a preselected propeller shaft speed for the slow travel mode. Said coordination between a trolling speed and an engine speed can be effected in accordance with specific operational parameters of the engine. Said parameters can be, for instance, fuel consumption, composition of the exhaust gas, or also other characteristics.

An embodiment of the invention is explained herebelow with reference to the drawings. In the drawings.

Figure 1:
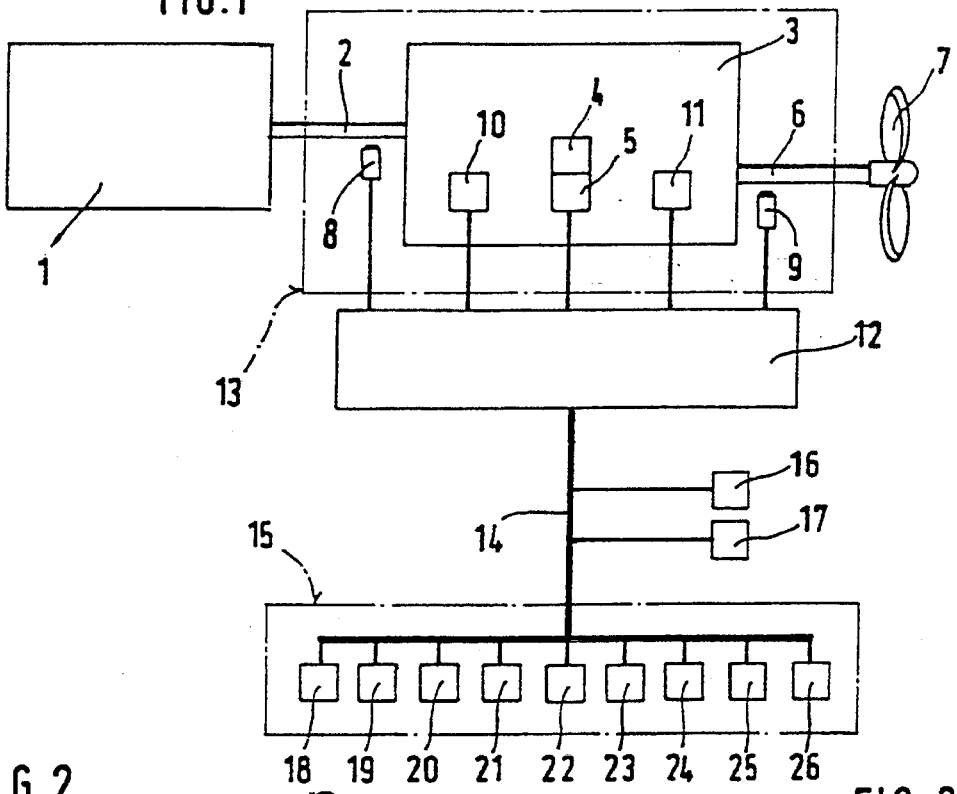
FIG. 1 is a diagram of a control system.

FIG. 1 is an extremely simplified diagrammatic illustration of a control system for operating a drive assembly of a ship. The drive assembly has at least one engine 1 whose output shaft 2 is connected with a transmission 3. Within the transmission 3, in a manner not shown in detail, are situated gears which are matingly connected with each other. There is at least one clutch 4. The clutch 4 can be operated in three switching positions: it is either fully open or fully closed. It can also be operated in an adjusted slip operation. The clutch 4 is preferably a hydraulically actuatable, wet-operating disc clutch. The degree of slip of the clutch 4 can be adjusted by means of a clutch pressure control 5. An output shaft, designated as propeller shaft 6, leads from the transmission 3 to a propeller 7.

The speed of the output shaft 2 of the engine 1 can be detected via a speed sensor 8. In order to detect the speed of the propeller shaft 6, another speed sensor 9 is synchronized therewith.

The transmission 3 is switched to a forward or a reverse motion by a direction of motion control 10. A temperature sensor 11 monitors the operating temperature of the clutch 4.

The speed sensors 8 and 9, the clutch pressure control 5 and the motion direction control 10 are connected with an electronic control unit 12. The transmission 3 with the sensor and control means 8, 9, 11 and 5 and 10, can be combined to form a structural unit 13.

The electronic control unit is attached to a control station 15 via an electric line 14. A terminal for a sensor 16 of the ship's speed and a terminal for a system plug 17 to which an instrument for the system diagnosis can be attached when needed are provided in the line 14.

The control station 15 comprises a series of control, switch and adjusting elements. Specifically they are an order transmitter 18 for the direction of motion, a nominal value transmitter 19 for the speed of the propeller shaft 6 in the slow motion (trolling mode) mode, a pilot lamp 20 which indicates to the pilot the regular operation of the drive assembly and two warning lights 21 and 22 which indicate deviation from the regular operation. An operation switch 23 serves to select the operation mode "slow (trolling) travel" and another operation switch 24 is provided for preselecting a reversing aid. The key 25 is an emergency switch and the power supply is connected or disconnected with the key 26.

An essential feature of the invention consists in that the pilot can use reversing aids in the slow travel mode, that is, during trolling operation (the operation switch 23 is actuated). By means of the operation switch 24, the pilot can preselect a specific reversing aid—according to his needs. The preselected reversing aid is activated when a certain control signal is transmitted to the electronic control unit 12.

Figure 2:
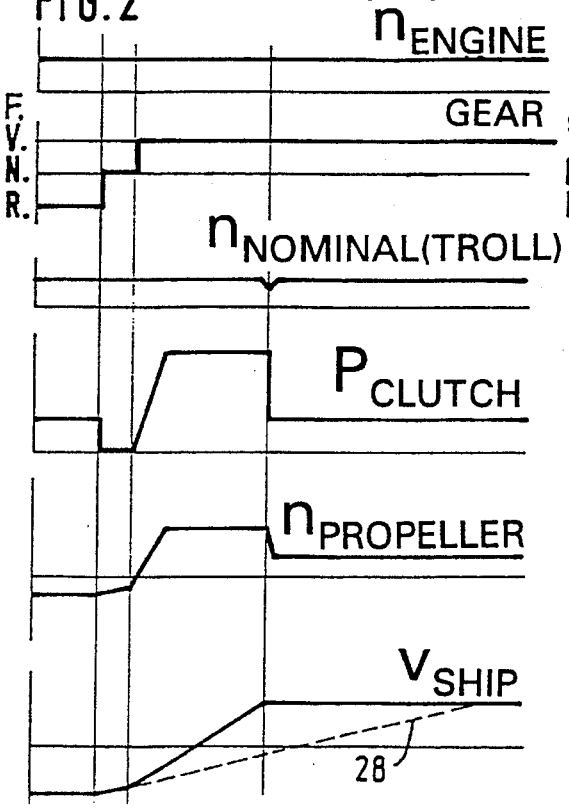
FIG. 2 and 3 are flow charts of reversing aids.

The flow chart of FIG. 2 illustrates how a reversing aid works which starts semi-automatically. The ship is driven at a specific engine speed such as 900 Rev./min. The transmission 3 is first switched to reverse (second diagram from the top). The ship moves in reverse in the slow motion mode at a propeller shaft speed of −100 Rev./min. The clutch 4 works in the adjusted slipping operation, that is, it is actuated with a specific clutch pressure which allows a relative movement between the disc sets (see the fourth diagram from the top). The speed of the propeller shaft corresponds in absolute amount to the trolling nominal speed of −100 Rev./min. The sign is negative because of the reverse motion. The ship moves, for instance, with a reverse motion, the gear is switched over a neutral position to the forward direction of motion (second diagram from the top). The clutch pressure is completely removed in the neutral position of the transmission. By switching to the forward direction of motion, the clutch becomes completely engaged in the acceleration phase so that the clutch pressure quickly reaches its maximum (see the fourth diagram from the top). The propeller shaft speed begins to increase and, in the instant embodiment, reaches its maximum at 400 Rev./min. This speed value depends on the prevailing engine speed and the gear ratio. The ship's speed slows down, goes through zero and begins to increase in a forward direction of motion (see bottom diagram).

With full engagement of the clutch in the acceleration phase, the ship is accelerated at the actual propeller shaft speed which depends on different influences such as the engine speed, the clutch pressure, the flow conditions, etc. The pilot observes the reaction of the ship. As soon as he deems the ship's reaction sufficient, he terminates the acceleration phase in the following manner:

A control lever 27, with which the trolling nominal speed is set, is momentarily adjusted in the sense of reducing the set trolling nominal speed. During this brief reduction, a negative adjustment gradient is produced and a corresponding control signal is transmitted to the control unit 12. Said control signal is interpreted by the control unit 12 in the sense that the acceleration phase must be terminated. The brief reduction of the trolling nominal speed that has been set is diagrammatically indicated (third diagram from the top) by the fact that an indentation is visible in the otherwise evenly extending characteristic line of the nominal trolling speed. As soon as the control electronics has received the control signal, the clutch pressure is reduced to a value corresponding to a clutch pressure such as it corresponds to the trolling nominal speed, or propeller shaft speed, or a desired speed of the ship.

The effectiveness of the reversing aid becomes clear when observing the lower diagram of FIG. 2. After engaging the forward direction of motion and after passing through the ship's speed of zero, the speed of the ship increases relatively quickly in the forward direction of motion until the pilot terminates the acceleration phase by producing the control signal in the above manner. Said time characteristic is identified in the lower diagram by the thick line. Compared to this, the dotted line 28 shows the time characteristic of the ship without the reversing aid. It can be seen that the desired ship's speed in the forward direction of motion is reached at a comparatively much later time.

Another reversing aid, related to the one explained above, consists in that the clutch 4, during trolling operation, is completely engaged immediately after engaging the forward direction of motion during the acceleration phase. The ship is thereby accelerated with a thrust proportional to the selected engine speed. As soon as the ship, taking into consideration the dynamics of the system, has reached the desired speed, the control electronics 12 interrupts the acceleration with the engaged clutch and sets the trolling speed on the propeller shaft until the nominal speed is reached. The mentioned sensor 16 serves to determine the ship's speed an send a signal corresponding to the speed to the control unit 12. Unlike the first reversing aid, this kind of reversing aid can start automatically.

Figure 3:
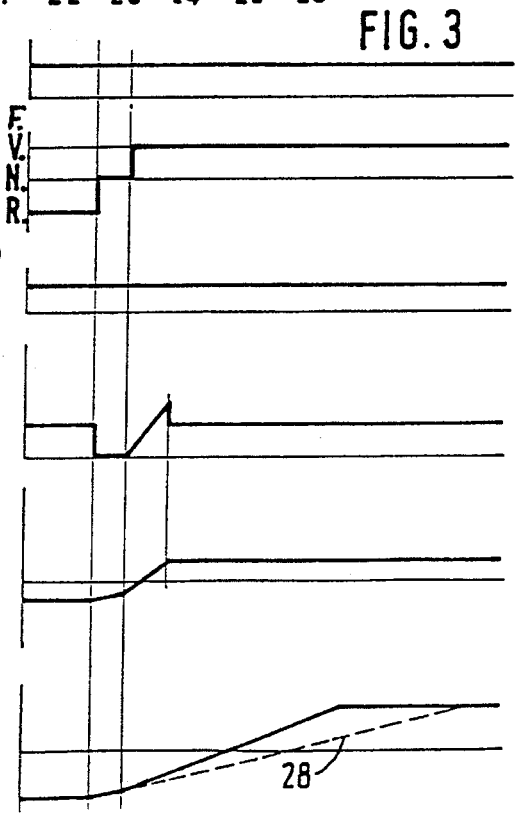

A third possibility of a reversing aid is to be seen from the diagram according to FIG. 3. From the fourth diagram from the top, when engaging the forward motion direction, the clutch 4 is first engaged to the extent that the preselected trolling speed and direction of rotation immediately result and appear on the propeller shaft 6. The control electronics 12 also keep the propeller shaft speed constant, which it does against a turbine drive torque acting upon the propeller 7. The explained reversing aid is to be used with a particular advantage specially when manoeuvres which require a slow increase in speed, such as is desired when towing must be effected.

A reversing aid can be selected or preselected with the operation switch 24. The control system, according to the invention, is specially flexible when all reversing aids are available as desired. In this case, the pilot is able, via the operation switch 24, to preselect one reversing aid 4—from a total of the three available ones. In this case, the drive assembly of the ship is suitable for the practical circumstances of every situation.

Figure 4:
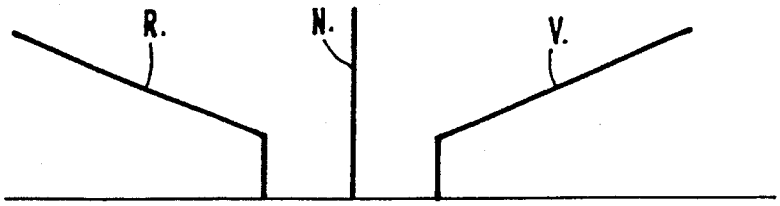
FIG. 4 to 6 are different speed diagrams depending on the swivel angle of a control lever.
Figure 5:
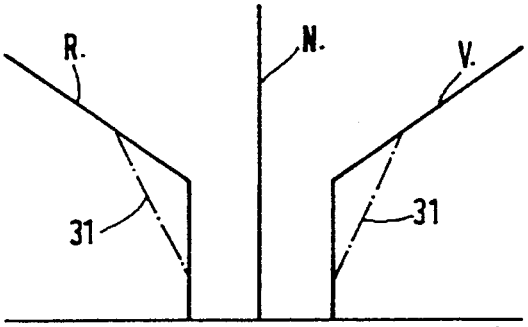
Figure 6:
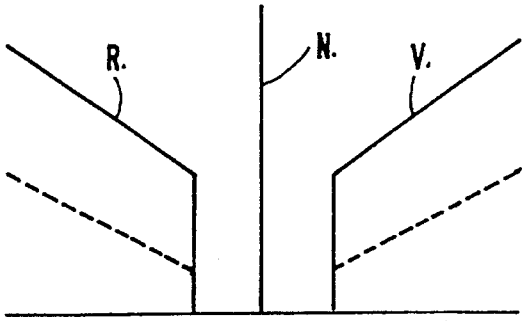

From the diagrams according to FIG. 4 to 6, the speed ratios depending on the swivel angles of the control levers coordinated therewith can be understood. The diagram of FIG. 4 is based on a deck controller having two levers. A first control lever allows the engagement of a specific direction of motion and the setting of a specific engine speed. Another control lever allows the setting of specific nominal trolling speed.

The diagram of FIG. 5 is based on a deck controller having one control lever. A specific direction of motion and a specific engine speed can be preselected with said control lever. In the range within which engine speeds can be set which are also admissible or adequate for the trolling drive, the arrangement is such that a superposition of the nominal value adjustment for a trolling speed automatically occurs with priority. Said ranges in which the driving is in a slow motion mode are indicated with dotted lines 31. It is advantageous that the speed be superimposed in a manner such that a minimal trolling speed be adjusted at a minimal engine speed. The maximum possible trolling speed is then coordinated with the maximum speed admissible in the trolling operation.

The diagram of FIG. 6 is based on a deck controller which may have either one or two control levers. During a cruise mode, the direction of motion is engaged and an engine speed adjusted with one or both control levers (dotted line). During the trolling operation, a presetting of the trolling propeller shaft speed is possible with one control lever (dotted lines). The electronic control unit 12 or a separate engine electronics assigns a specific engine speed to a preselected trolling speed. Said assignment occurs in accordance with specific operational parameters of the engine or of the transmission. Said operational parameters are characteristic quantities such as the fuel consumption, the thermal stress of the clutch, or also values of the exhaust gas emission.

Figure 7:
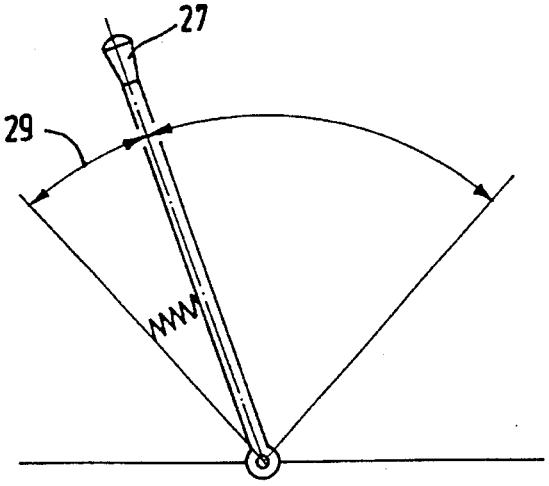
FIG. 7 shows a diagrammatic representation of a control lever with which a negative adjustment gradient is produced.

In FIG. 7 the control lever 27 or controller with which a trolling speed can be adjusted is diagrammatically illustrated. The control lever 27 is movable between two end positions (for instance, 0% and 100%). In a sector 29, which adjoins an end position (0%), the control lever 27 is movable in the sense of further reduction only against a resistance such as the force of a compression spring 30. With this feature a negative adjustment gradient can also be produced when the control lever 27 is in an end position from which another reduction of the trolling nominal speed is positively no longer possible. The above explained feature increases the passive safety of the system.

| Reference numerals | |
|---|---|
| 1 | engine |
| 2 | output shaft |
| 3 | transmission |
| 4 | clutch |
| 5 | clutch pressure control |
| 6 | propeller shaft |
| 7 | propeller |
| 8 | speed sensor |
| 9 | speed sensor |
| 10 | direction of motion control |
| 11 | temperature sensor |
| 12 | control electronics |
| 13 | structural unit |
| 14 | electric line |
| 15 | control station |
| 16 | sensor for ship's speed |
| 17 | system plug |
| 18 | order transmitter |
| 19 | nominal value transmitter |
| 20 | pilot lamp |
| 21 | warning light |
| 22 | warning light |
| 23 | operation switch |
| 24 | operation switch |
| 25 | key |
| 26 | key |
| 27 | control lever, selector switch |
| 28 | dotted line |
| 29 | sector |
| 30 | compression spring |
| 31 | dotted line |

We claim:

1. A control system for operating a drive assembly of a ship having at least one engine (1) which, via a transmission (3) with at least one adjustable clutch (4) for forward movement and one adjustable clutch (5) for reverse movement, drives a propeller shaft (6), sensor means for sensing at least propeller shaft speed and engine output speed, control means (5, 8, 9, 10, 11, 12, 16, 17, 27) for controlling engine speed and slipping degree of said clutch (4), at least one control station (15) with control means (18–26) having at least one steering lever (27), for adjusting travel direction and speed of the ship by actuating said steering lever and control means (12) for processing signals input from said control station and said sensor means and outputting signals to said control means for controlling engine speed and slipping degree of said clutch (4), said system comprises at least one reversing sequence for selectively engaging and reversing a travel direction of said ship during operation of said system in a low gear trolling mode of said drive assembly:

upon actuation of said steering lever (27) for engaging a travel direction, said control unit (12) outputs a signal to said control means to completely close a said clutch (4 or 5) corresponding to the engaged travel direction, such that there is no slipping of said engaged clutch and said propeller shaft is driven at maximum speed in said engaged direction during an acceleration phase;

means for indicating achievement of a desired speed of said ship in the engaged direction and transmitting an indication to said control unit (12), upon receipt of said indication, said control unit (12) terminates the acceleration phase by outputting a signal to said control means to convert said engaged clutch (4 or 5) to a controlled slipping operation which results in a reduction of the propeller shaft speed.

2. A control system according to the preamble of claim 1, wherein during a first said reversing sequence, said control lever comprises said means for indicating achievement of a desired speed of said ship and said indication is defined by a negative gradient adjustment of said steering lever.

3. A control system according to claim 1, wherein during said reversing sequence, a speed sensor for sensing the speed of said ship comprises said means for indicating achievement of a desired speed of said ship, said speed sensor transmits a signal corresponding to a present speed of the ship to said control electronics (12) and said indication is defined by a said present speed signal that is equal to the desired speed of the ship.

4. A control system according to claim 1, wherein during said reversing sequence, upon actuation of said steering lever (27) for engaging a travel direction, said control unit outputs a signal to said control means to engage said engaged clutch to the extent that the speed of said propeller shaft (6) is at the speed necessary to maintain said desired speed of said ship and said control unit (12) maintains the speed of the propeller shaft constant.

5. A control system according to claim 2, wherein during a second said reversing sequence, a speed sensor for sensing the speed of said ship comprises said means for indicating achievement of a desired speed of said ship, said speed sensor transmits a signal corresponding to a present speed of the ship to said control electronics (12) and said indication is defined by a present speed signal that is equal to the desired speed of the ship.

6. A control system according to claim 5, wherein during a third said reversing sequence, upon actuation of said steering lever (27) for engaging a travel direction, said control unit outputs a signal to said control means to engage said engaged clutch to the extent that the speed of said propeller shaft (6) is at a speed necessary to maintain said desired speed of said ship and said control unit (12) maintains the speed of the propeller shaft constant.

7. A control system according to claim 6, further comprising means for preselecting a reversing sequence.

8. A control system according to claim 1, wherein said steering lever is switchable between two end positions for selecting the travel speed and direction, said steering lever (27) is adjustable against a biasing member in the range adjacent one of the end positions.

9. A control system according to claim 8, further comprising an additional steering lever for selectively adjusting the travel speed of the engine, in a first range of said additional steering lever, said engine can be adjusted in speeds admissible for the low gear trolling mode and an adjustment of the propeller shaft speed is superimposed on the system so that, in said first range of said additional steering lever, the drive assembly is operated in the low gear trolling mode.

10. A control system according to claim 8, wherein said super-imposition is effected by electric means.

11. A control system according to claim 1, wherein said control unit (12) automatically synchronizes the engine speed, which is dependent on operating parameters of said engine, with a preselected propeller shaft speed for the low gear trolling mode.

12. A control system for operating a drive assembly of a ship having at least one engine (1) which, via a transmission (3) with at least one adjustable clutch (4) for forward and reverse movements, drives a propeller shaft (6), control and sensor means (5, 8, 9, 10, 11, 12, 16, 17, 27) for controlling at least one of engine speed and slipping degree of said clutch (4), at least one control station (15) with control means (18–26) for adjusting travel direction and speed of the ship by actuating at least one steering lever (27) and control electronics (12) for processing input and output signals, characterized in that during operation in a low gear trolling mode of said drive assembly, said clutch (4) becomes completely closed after engaging a travel direction and an acceleration phase is terminated by transmitting to said control electronics (12) a control signal which is a negative gradient adjustment of said steering lever converting said clutch (4) to a controlled slipping operation resulting in a reduction of trolling speed.

13. A control system for operating a drive assembly of a ship having at least one engine (1) which, via a transmission (3) with at least one adjustable clutch (4) for forward and reverse movements, drives a propeller shaft (6), control and sensor means (5, 8, 9, 10, 11, 12, 16, 17, 27) for controlling at least one of engine speed and slipping degree of said clutch (4), at least one control station (15) with control means (18–26) for adjusting travel direction and speed of the ship by actuating at least one steering lever (27) and control electronics (12) for processing input and output signals, characterized in that during operation in a low gear, trolling mode of said drive assembly, said clutch (4) becomes completely closed after engagement of the travel direction, and the acceleration phase is terminated by transmitting to said control electronics (12) a control signal which indicates that a defined speed of the ship has been reached thereby adjusting the speed of said propeller shaft (6) to a trolling speed.

14. A control system for operating a drive assembly of a ship having at least one engine (1) which, via a transmission (3) with at least one adjustable clutch (4) for forward and reverse movements, drives a propeller shaft (6), control and sensor means (5, 8, 9, 10, 11, 12, 16, 17, 27) for controlling at least one of engine speed and slipping degree of said clutch (4), at least one control station (15) with control means (18-26) for adjusting travel direction and speed of the ship by actuating at least one steering lever (27) and control electronics (12) for processing input and output signals, characterized in that during operation in a low gear, trolling mode of the drive assembly, said clutch (4) is closed to the extent that the preselected trolling speed and direction of rotation are adjusted in said propeller shaft (6) and in a transition range where said propeller (7) acts as a turbine, said control electronics (12) keeps constant the preselected speed of the propeller shaft.

* * * * *